United States Patent [19]

Hines

[11] 3,973,225

[45] Aug. 3, 1976

[54] FEATHER-EDGE PHASE SHIFTER

[75] Inventor: Marion E. Hines, Weston, Mass.

[73] Assignee: The United States of America as represented by the Secretary of the Army, Washington, D.C.

[22] Filed: Aug. 29, 1975

[21] Appl. No.: 609,317

[52] U.S. Cl. ..... 333/24.1; 333/98 R

[51] Int. Cl.[2] ..... H01P 1/40

[58] Field of Search ..... 333/24.1

[56] References Cited

UNITED STATES PATENTS 3,316,506 4/1967 Whicker et al. ..... 333/24.1

3,521,198 7/1970 Shahbender ..... 333/24.1 X

*Primary Examiner*—Paul L. Gensler

*Attorney, Agent, or Firm*—Lawrence A. Neureither; Jack W. Voigt; Robert C. Sims

[57] ABSTRACT

A feather-edge conductive pattern is sandwiched between two ferrite bars so as to cause different degrees of residual magnetism in the bars. Two other blocks of materials having relative high dielectric constants sandwich the ends of the bars, and the whole device is inclosed in a waveguide which will have variable phase shifts in accordance to the residual magnetism of the bars.

1 Claim, 4 Drawing Figures

FEATHER-EDGE PHASE SHIFTER

BACKGROUND OF THE INVENTION

This invention is related to the field of phase shifters. Patents numbered U.S. Pat. Nos. 3,393,383 and 3,845,413 illustrate examples of the prior art which this invention is an improvement over.

SUMMARY OF THE INVENTION

The invention is a new form of microwave phase shifter. This device is a special transmission line for microwave power which can be electronically controlled in a manner which causes a variation in its apparent or electrical length. Such variations change the phase shift of the output wave compared with the input wave, by changing the phase velocity of microwave propagation. This invention utilizes a ferrite magnetic material which is a dielectric and which has a magnetic susceptability at high frequency which varies when subjected to a change in the steady magnetic field applied. In this invention, a form of ferrite is used which may be permanently magnetized in one direction or another by application of a short duration magnetic pulse. In such cases, the microwave magnetic properties depend upon the direction and magnitude of the permanent or remanent magnetization which is retained after application of such a pulse. In this way, a short magnetic pulse sets the phase shifter to any chosen one of many possible desired values of internal magnetization, and at the same time, to one of the many possible phase-shift settings. The magnetic pulse is obtained by passing a short pulse of electrical current through the internal conductor. In this way, no continued magnetizing current is required to maintain the phase shift setting, once set or latched in this way.

DESCRIPTION OF THE PREFERRED EMBODIMENT

Figure 1:
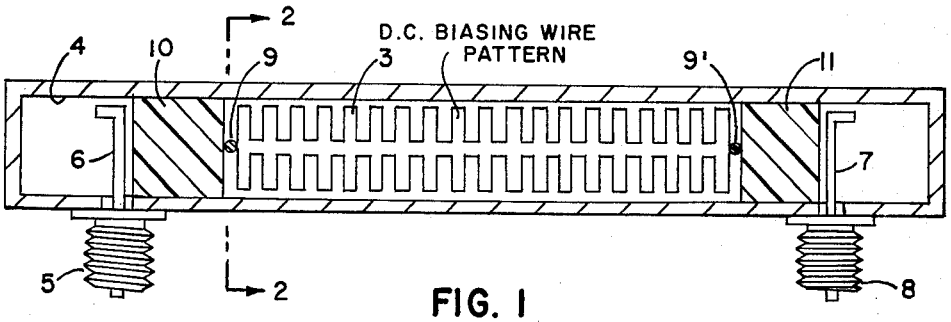
FIG. 1 is a sectionalized overall view of the present invention.
Figure 2:
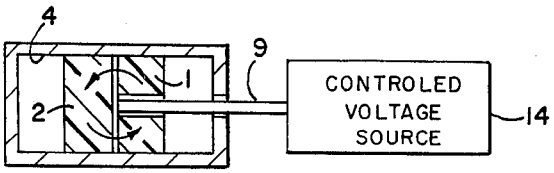
FIG. 2 is in part a section of FIG. 1 taken line by lines 2—2.
Figure 3:
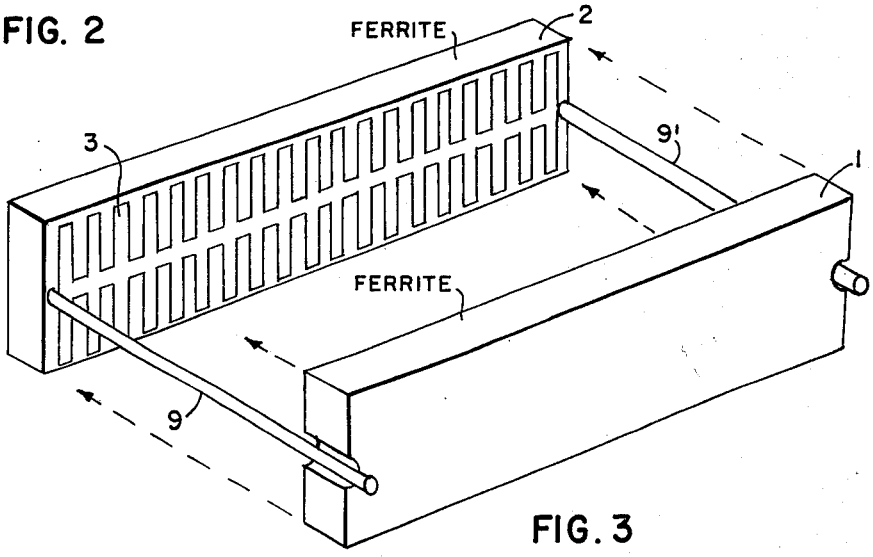
FIG. 3 is an exploded view of the ferrite bars and wire portion of the present invention.

In this invention, illustrated in FIGS. 1–3, two flat plates 1 and 2 of ferrite material are used to sandwich a printed-circuit thin-film metallic pattern 3 which is deposited on one of the plates. This pattern 3 serves the same function as a wire and may carry an electrical current along the axis. The conductor is intermittently energized with a pulse of current by way of wires 9 and 9′ to change the magnetization of the ferrite bars 1 and 2 and with it, the phase shift. Since the current cause by this pulse is mostly along the axis, the magnetization is circumferential in orientation, about the axis, as shown by arrows in FIG. 2 and may be given either of two opposite directions or senses of magnetization. The remanent magnetization may also have various intensities, depending upon the magnitude and direction of the current pulse applied. The feather-edge pattern of wire 3 serves to cause a reduction in the phase-velocity of the wave. This feather-edge pattern has an effect similar to that of placing a high-dielectric-constant material between the bars 1 and 2. The ferrite structure fits within a hollow rectangular metallic tube 4 which acts as a waveguide between antennas 6 and 7.

Referring now to FIG. 3, there is shown the two slabs of ferrite 1 and 2 which are accurately ground and polished on the two flat mating surfaces. On one of these mating surfaces, a thin film metallic patterned wire 3 is deposited which resembles the structure of a feather or fishbone, with a spine running centrally along the length, and many slender ribs protruding perpendicularly toward, but stopping short of the edges. These two bars are placed face-to-face, with only the thin metal film between. If an electric current is passed end-to-end along the central spine of the feather a magneto-motive force is induced circumferentially, causing a magnetization pattern as illustrated in FIG. 2, the lines of force assuming a somewhat elliptical shape. If the current is pulsed on and then off again, a degree of permanent or remanent magnetization remains in the configuration of the arrows shown in FIG. 2. If the current pulse is great enough to saturate the material, it will remain magnetized to a maximum degree in either direction. If less current is applied, the degree of remanent magnetization depends also upon the state in which it was originally magnetized before the pulse was applied. This behavior of ferromagnetic materials is well known.

As pictured in FIGS. 1 and 2, the ferrite bars 1 and 2 are inserted into a waveguide 4 which is a rectangular metal tube. At one end of the tube, a coaxial line 5 carrying the input signal wave is attached to an internal antenna 6 which serves as a transducer, transforming the signal energy from the TEM coaxial mode into the $TE_{10}$ transmission mode of the waveguide. Within the waveguide, between the antenna and the ferrite bars are two blocks of materials 10 and 11 each with a relatively high dielectric constant. Their dielectric constant and length are carefully chosen to act as an impedance transformer for the waveguide energy, permitting nearly reflectionless launching of the signal wave into the active ferrite region. The wave energy passes through the waveguide, a significant part of which passes through the ferrite bars 1 and 2. The wave velocity depends upon the sense and degree of magnetization. Waves may pass backward through the phase shifter as well as forward, and the device is non-reciprocal. That is, the phase shift is unequal for the two directions of wave propagation. After passing through the ferrite region, the energizing wave is transformed again through a block 11 to the antenna 7 to the output coaxial line 8. Two conducting wires 9 and 9′ are passed through holes in the side of the waveguide. To change the magnetization, these wires are energized with a current pulse, by a controlled voltage source 14 connected between the wires.

The ferrite material 1 and 2 and the feather metallic pattern 3 within cause some modification of the electric and magnetic field patterns of the microwave signal being transmitted. The ferrite has a relatively high dielectric constant, on the order of 12–15, which acts to reduce the phase velocity by increasing the distributed capacitance in the waveguide. In addition, the numerous vertical metal-film ribs act as an artificial dielectric along the center, causing a still further reduction in the wave velocity. As the wave propagates, high frequency electric currents flow along the thin metallic ribs in the plane between the ferrite bars, traverse to the axis in a wave pattern which propagates at a velocity slower than the velocity with which free or plane waves would propagate in a large volume of the ferrite material. It is a property of Maxwells' equations (which govern all radio propagation phenomena) that the high frequency (microwave) magnetic fields associated with such waves exhibit elliptical rather than plane polarization, with an r-f magnetic field vector whose direction in space rotates at the microwave frequency. In this particular structure, the magnetic field vector in the central region of the ferrite bars lies in the H-plane of the waveguide, a plane which is parallel with the waveguide axis and perpendicular to the thin film metallic pattern of FIG. 3. In one of the two ferrite bars, the sense of rotation of the microwave magnetic field vector is opposite to the direction of rotation in the mating ferrite bar, and this rotating vector lies in a plane which is perpendicular to the magnetization direction of the remanent steady magnetization shown in FIG. 2.

It is well known that microwave propagation in a magnetized ferrite, which has an elliptically polarized r-f magnetic field, is strongly affected by the sense and strength of steady magnetization which is oriented in this way. This is the gyro-magnetic property of ferrites which finds many applications in various other microwave devices. For a given signal direction, with a given sense of rotation of the elliptically polarized field, the effective magnetic permeability of the material may increase as the steady magnetization is increased in one direction, but, will decrease with increasing magnetization which is directed in the opposite sense. In the magnetized ferrite bars 1 and 2 in this device, the steady magnetization is oppositely directed in the two bars, as is also the sense of rotation of the microwave magnetic vector. A current pulse which sets the steady magnetization may be applied in one direction by source 14, increasing the effective magnetic permeability for the r-f wave in both bars. On the other hand, a current pulse which causes a reversal of the steady magnetization will cause a decrease in the effective magnetic permeability for the r-f wave. The result is a greater phase shift for one sense of the applied magnetizing current pulse than for an oppositely directed current pulse.

The feather pattern between the ferrite bars may be tailored to provide slower wave propagation velocity, with the wave energy being more tightly confined to a small cross-section area. This increases the activity of the device, providing more phase shift per unit length with a reduced cross-sectional area of ferrite material. The degree of such increased activity is controllable by varying the length and width of the ribs on the metallic pattern. If the ribs are very narrow, very closely spaced, and extend very nearly to the edge of the ferrite bars, then the structure may be very small indeed. This reduces the necessary cross-sectional area of the structure and the length as well. The amount of phase shift per unit length increases as the r-f field become concentrated into a smaller cross-section area.

Figure 4:
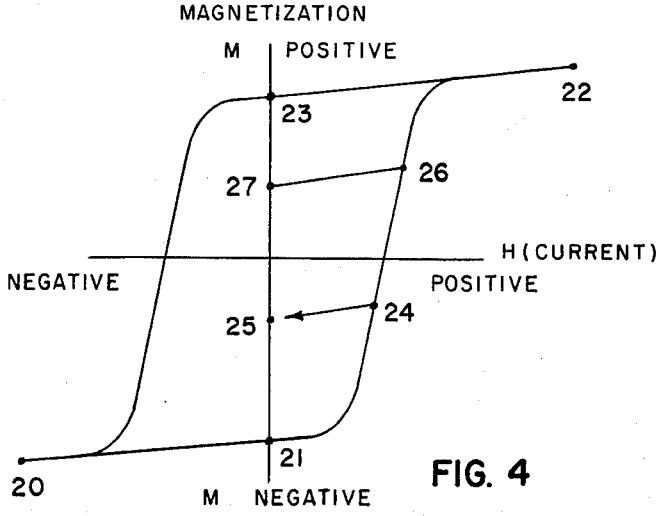
FIG. 4 shows the magnetization and hysteresis curves of the ferrite bars.

As described above, this is a latching phase shifter which utilizes the permanent magnetization capability of common ferrite materials. The magnetization characteristics are commonly described with a hysteresis loop diagram as in FIG. 4. Here we show a graph of the magnetization M versus the magnetizing force H. The force H is directly proportional to the current in an electrical coil or loop used to affect the magnetization. The desired microwave effects of the ferrite depend primarily on the value of M when the current, (and H) is zero. On this graph are shown numbered points. Points 21, 23, 25, and 27 show four possible desired levels of magnetization in the absence of current flow ($H = 0$). These provide four distinct values of phase shift. Actually, a continuous distribution of values is possible between points 21 and 23. We now describe how these four levels may be achieved. For each new setting, the current is first pulsed strongly negative, saturating the magnetization negatively and achieving the state shown as point 20. If now, the current is turned off, we follow the curve to the point 21, leaving a maximum negative value of permanent magnetization. To achieve the maximum positive permanent magnetization of point 23, we may apply a strong positive current, achieving temporarily the state of point 22. If, now, the current is turned off, the curve is followed down to point 23. To achieve an intermediate state such as point 25, we recycle to point 20 with a negative pulse, then apply a more modest positive current appropriate for the point 24. Removal of the current in this case permits relaxation to the point 25. Similarly we may achieve the state of point 27 by recycling again, first to point 20, then to point 26 with a somewhat stronger current than before, which then relaxes to point 27 when the current is turned off. In this way, any value of permanent magnetization between point 21 and point 23 may be induced. In each case, to achieve a new predetermined value of magnetization we recycle, first with a strong negative pulse to point 20, followed by a controlled positive pulse of current, the final state depending upon the magnitude of the applied positive current pulses.

I claim:

1. A phase shifter comprising a hollow conducting waveguide; wire means; two pieces of ferrite magnetic material sandwiching said wire means and being inserted in said waveguide; source means connected to said wire means so as to provide magnetization of said magnetic materials; means to launch a high frequency wave through said waveguide for phase shifting of said wave; said wire means is a feather-edge conductive surface pattern, said two magnetic materials are bar means; said wire means is a printed circuit deposited on one of the bars; first and second blocks of high dielectric constant materials inserted at opposite ends of said bar means; and said means to launch the high frequency wave through the waveguide also transmittes the wave through one of said blocks of materials, then through said bar means, and then through the other block of high dielectric constant material.

* * * * *